US005370452A

United States Patent [19]

Baer

[11] Patent Number: 5,370,452

[45] Date of Patent: Dec. 6, 1994

[54] CABINET FOR HAIR SALON UTENSILS

[75] Inventor: Jeffrey A. Baer, Rockford, Ill.

[73] Assignee: Smith Investment Company, Belvidere, Ill.

[21] Appl. No.: 82,485

[22] Filed: Jun. 28, 1993

[51] Int. Cl.[5] ..... A47B 81/00

[52] U.S. Cl. ..... 312/24; 312/209; 312/276

[58] Field of Search ..... 312/24, 26, 30, 209, 312/276, 224, 223.3, 328

[56] References Cited

U.S. PATENT DOCUMENTS

| | | | |
|---|---|---|---|
| 739,451 | 9/1903 | Schwartz | 312/328 |
| 1,443,858 | 1/1923 | Windecker | 312/276 X |
| 1,920,171 | 8/1933 | Gerstner | 312/276 X |
| 2,427,218 | 9/1947 | Liebson | 312/276 X |
| 2,775,342 | 12/1956 | Smith | 312/276 X |

FOREIGN PATENT DOCUMENTS

| | | | |
|---|---|---|---|
| 875665 | 8/1961 | United Kingdom | 312/276 |
| 1537134 | 12/1978 | United Kingdom | 312/328 |

*Primary Examiner*—Kenneth J. Dorner
*Assistant Examiner*—David E. Allred
*Attorney, Agent, or Firm*—Vernon J. Pillote

[57] ABSTRACT

A cabinet for hand-held hair salon utensils having spaced side walls, a top panel mounted for movement about a horizontal axis adjacent a rear end of the top panel between a lower closed position and a raised open position, and a front panel mounted for movement about a horizontal axis adjacent a lower end of the front panel. A utensil support panel is mounted on the top panel with a forward end of the utensil support panel spaced below the top panel and a linkage is arranged to move the upper end of the front panel forwardly to an open position in response to movement of the top panel to the raised position. The utensil support panel has a plurality of openings for receiving ends of hair salon utensils with the utensil handles above the support panel.

8 Claims, 2 Drawing Sheets

CABINET FOR HAIR SALON UTENSILS

BACKGROUND OF THE INVENTION

Storage of hand-held hair dryers and curling irons and their attendant power cords is perceived as a problem in many hair styling salons. The hair salon utensils and cords often look unkept and create clutter when stored on a shelf or cabinet top, and some salon owners prefer enclosed storage for these tools. However, because of the attached power cords, enclosure can impede accessibility and use of these tools.

SUMMARY OF THE INVENTION

It is the object of the present invention to provide a cabinet for hand-held hair salon utensils which enables the utensils and their cords to be easily removed and reinstalled in the cabinet when the cabinet is open, and which encloses and conceals the utensils and cords when the cabinet is closed.

Accordingly, the present invention provides a cabinet for hand-held hair salon utensils having spaced side walls, a top panel, a front panel, hinge means supporting the top panel for movement about a generally horizontal axis adjacent a rear end of the top panel between a lower closed position and a raised open position, hinge means supporting the front panel for movement about a generally horizontal axis adjacent a lower end of the front panel, and a utensil support panel mounted on the top panel with a forward end of the utensil support panel spaced below the top panel. Linkage means are provided for moving the upper end of the front panel forwardly to an open position in response to movement of the top panel to the raised position and for moving the upper end of the front panel rearwardly to a closed position in response to movement of the top panel to the lower position. The utensil panel is fixed to the top panel for movement with the top panel so that the clearance with the utensil handles remains the same when the cabinet is opened or closed. Tilting of the front panel forwardly when the top panel is raised, provides a larger opening forwardly of the upper utensil panel to facilitate withdrawal and storing of the cords attached to the various utensils.

The utensil support panel has a plurality of openings for receiving ends of hair salon utensils with the utensil handles above the support panel. The utensil support panel advantageously extends downwardly and forwardly from the top panel at an angle of less than ninety degrees so that the utensil panel remains inclined to the vertical when the cabinet is closed, to aid in retaining the utensils in the openings in the utensil support panel.

The linkage means for opening and closing the front panel includes a link pivotally connected at one end to the utensil support panel and at an opposite end to the front panel. The top panel is conveniently supported in a raised position by a telescopically adjustable stay pivotally attached at one end to a bottom panel on the cabinet and at an opposite end to the utensil support panel.

DETAILED DESCRIPTION

Figure 1:
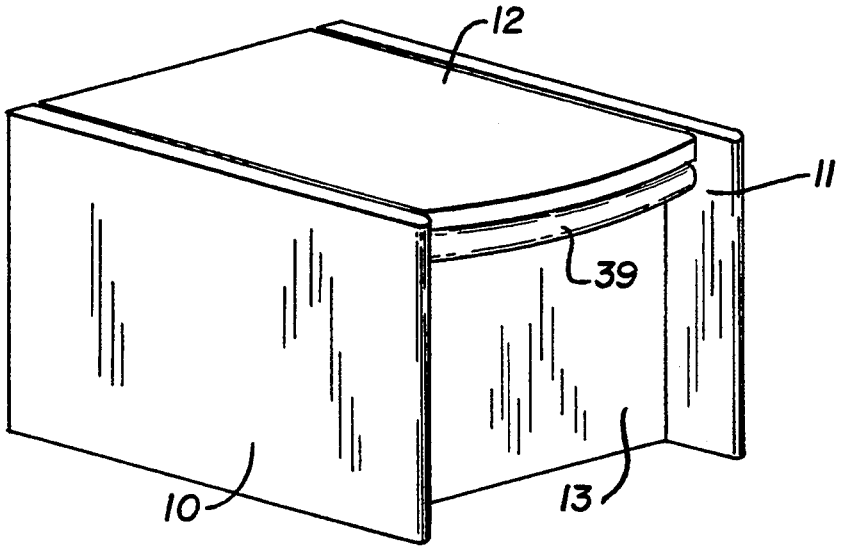
FIG. 1 is a perspective view of the cabinet in a closed condition.

The cabinet for hand-held hair salon utensils in general includes spaced side walls 10 and 11, a top panel 12 and a front panel 13. A rear panel 14 extends between a rear end of the side panels and a bottom panel 15 extends between a lower end of the side panels. The rear and bottom panels are fixed to the side panels by suitable fasteners, adhesive or both. The rear panel 14 is spaced above the bottom of the side panels to provide an opening at the rear of the cabinet for passage of the utensil cords therethrough and enable plugging of the utensil cord in a suitable electrical outlet (not shown) externally of the cabinet.

Figure 2:
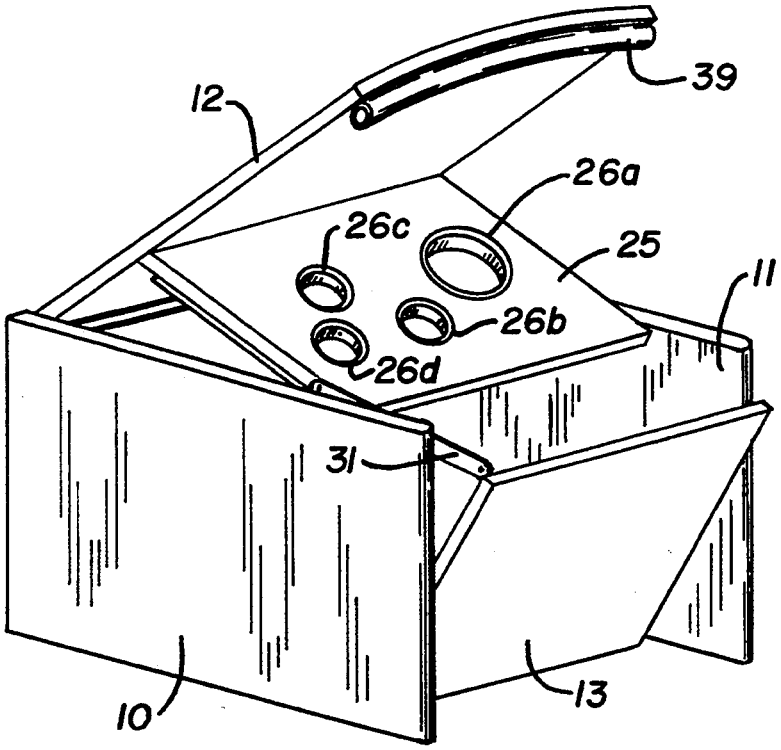
FIG. 2 is a perspective view of the cabinet in an opened condition.
Figure 3:
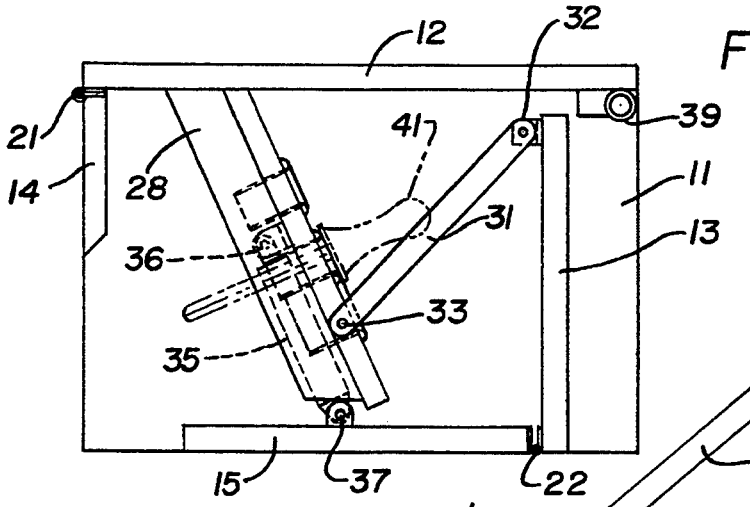
FIG. 3 is a view of the cabinet with one side panel removed and illustrating the cabinet in a closed condition.
Figure 4:
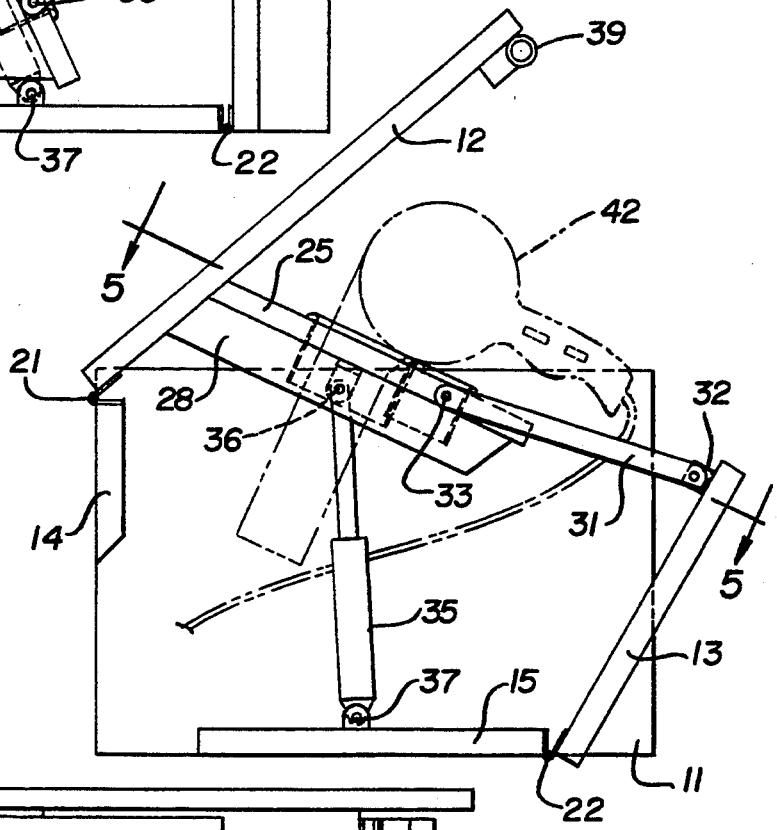
FIG. 4 is a view of the cabinet with one side panel removed and illustrating the cabinet in an opened condition.

The top panel 12 is hingedly connected at its rear end to the cabinet as by a hinge 21 at the upper end of the back panel 14. The front panel 13 is hingedly connected at its lower end to the cabinet as by a hinge 22 mounted at a front end of the bottom panel 15. The top panel is movable between a generally horizontal closed position shown in FIGS. 1 and 3 and a raised open position as shown in FIGS. 2 and 4.

Figure 5:
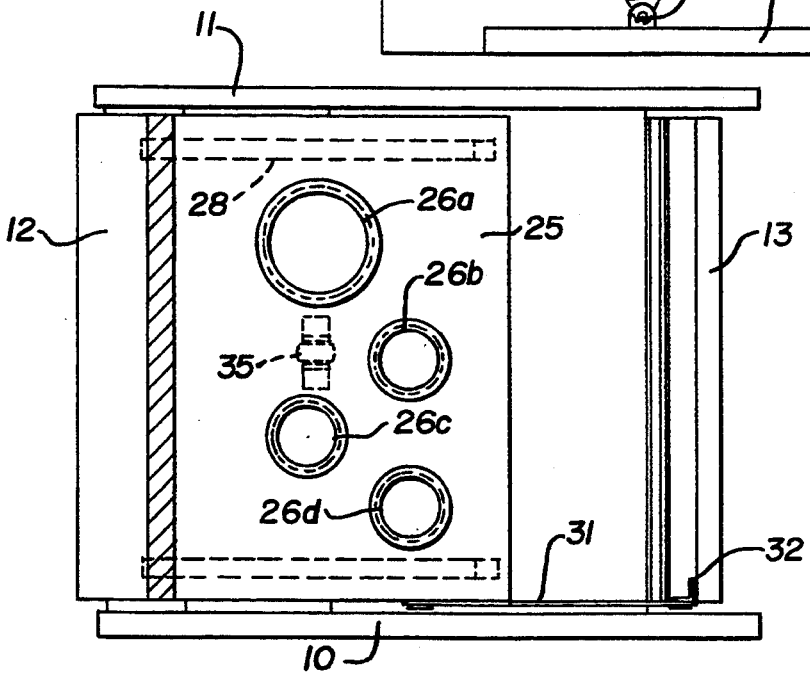
FIG. 5 is a fragmentary sectional view taken on the plane 5—5 of FIG. 4.

A utensil panel 25 is mounted on the top panel for movement with the top panel and with a forward end of the utensil panel spaced below the top panel. The utensil panel has a plurality of utensil receiving openings therein designated 26*a*, 26*b*, 26*c* and 26*d* in FIGS. 2 and 5. The openings are preferably provided with metal sleeves to protect the utensil panel and limit tilting of the utensils during opening and closing of the cabinet.

The utensil panel 25 is mounted to extend at an angle of less than ninety degrees relative to the top panel so that the utensil panel is inclined downwardly and forwardly when the top panel is closed, to aid in preventing the hair salon utensils from dropping out of the openings. The utensil panel preferably extends at an included angle of about sixty-five degrees, plus or minus five degrees, with respect to the top panel. In the embodiment illustrated, the utensil panel has stiffening rails 28 along opposite side edges. The utensil panel may be secured to the top panel in any suitable manner as by brackets, fasteners and the like.

Mechanism is provided for moving the front panel 13 between a generally upright closed position when the top panel is closed and an upwardly and forwardly inclined open position when the top panel is raised. In the preferred embodiment illustrated, this mechanism includes a link 31 pivotally connected at one end to an angle bracket 32 fixed to the front panel, and pivotally connected at its other end as by a pin 33 to the utensil panel. As will be seen from FIGS. 2 and 3, the forward end of the utensil panel 25 moves upwardly and forwardly when the top panel is raised and the ends of the link 31 are pivotally connected to the front panel and the utensil panel at locations so as to move the upper end of the front panel forwardly to increase the space between the front panel and the utility panel when the top panel is opened, and thereby facilitate withdrawing and storing of the cords for the hair salon utensils.

Mechanism is provided for releasably holding the top panel in a raised condition. The holding means could be directly connected to the top panel. However, the holding means is preferably in the form of a telescopically adjustable stay 35 that is pivotally attached by an angle bracket 36 to the underside of the utensil panel 25 and at an opposite end by an angle bracket 37 to the bottom panel 15. The telescopically adjustable stay 35 is of a conventional construction having telescopically adjustable members that can be releasably retained in an extended position as shown in FIG. 4 as by ball detents or a toggle.

In the embodiment illustrated, the top panel 12 and front panel 13 are disposed between the side panels when in a closed condition. A tube 39 provided on the underside of the top panel adjacent its forward end, can serve as a handle while raising the top panel.

From the foregoing it is believed that the construction, operation and use of the cabinet will be readily understood. Hand-held hair salon utensils such as an electrical hair dryer and one or more curling irons can be mounted in the openings *26a–2d* in the utensil panel with the operating ends of the utensils extending below the panel and with the handle ends of the utensils above the panel. The electrical cords extending from the handle ends of the utensils are passed between the front end of the utensil panel and the rear side of the front panel when the cabinet is opened, and the cords are extended below the utensil panel and through the opening in the rear of the cabinet for connection to a suitable receptacle outlet. The utensil panel supports the utensils in a conveniently accessible condition when the top panel is opened and the space between the utensil panel and the front panel allows easy withdrawal and storage of utensil cords in the cabinet. When the top panel is moved down to its closed position, the front panel is moved rearwardly to its closed position while the utensil panel moves downwardly, to confine the utensil cords in the cabinet. When closed, the utensil panel extends downwardly and forwardly at an angle less than 90 degrees so that the utensils such as a hair curler shown at 41 in FIG. 3 and a hair dryer shown at 42 in FIG. 4, are supported in openings in the utensil panel with the handle ends at the front side of the utensil panel and with the operating ends of the utensils at the rear side of the utensil panel.

The embodiments of the invention in which an exclusive property or privilege is claimed are defined as follows:

1. A cabinet for hand-held hair salon utensils, the cabinet including spaced side walls, a top panel, and a front panel, hinge means supporting the top panel for movement about a generally horizontal axis adjacent a rear end of the top panel between a lower closed position and a raised open position, hinge means supporting the front panel for movement about a generally horizontal axis adjacent a lower end of the front panel, a utensil support panel having a plurality of utensil receiving openings therein and means fixedly mounting the utensil support panel on the top panel for movement as a unit therewith, the utensil support panel having an upper side extending downwardly and forwardly from an underside of the top panel at an angle of less than ninety degrees and such that the utensil support panel is inclined downwardly and forwardly when the top panel is in the lower closed position and when the top panel is in the raised open position, linkage means responsive to movement of the top panel to the raised open position for moving an upper end of the front panel forwardly to an open position and responsive to movement of the top panel to the lower closed position for moving the upper end of the front panel rearwardly to a closed position.

2. A cabinet according to claim 1 wherein said angle is between sixty and seventy degrees.

3. A cabinet according to claim 1 wherein said angle is substantially sixty-five degrees.

4. A cabinet according to claim 1 wherein said linkage means includes a link pivotally connected at one end to said utensil support panel and pivotally connected at an opposite end to said front panel.

5. A cabinet according to claim 1 wherein said cabinet includes a bottom panel, and a telescopically adjustable stay pivotally attached at a first end to said bottom panel and pivotally attached at a second end to said utensil support panel for releasably supporting the utensil panel in a raised position with the top panel in said open position.

6. A cabinet according to claim 1 wherein said cabinet includes a bottom panel, and a telescopically adjustable stay pivotally attached at a first end to said bottom panel and pivotally attached at a second end to said utensil support panel for releasably supporting the utensil support panel in a raised position when the top panel is in said open position, said linkage means includes a link pivotally connected at one end to said utensil support panel and pivotally connected at an opposite end to said front panel.

7. A cabinet according to claim 1 wherein the utensil receiving openings in the utensil support panel includes an opening dimensioned for receiving a discharge end of a hand-held hair dryer and at least one opening dimensioned for receiving an end of a hand-held hair curler.

8. A cabinet according to claim 1 including a metal sleeve in the opening for receiving an end of a hair dryer and the opening for receiving an end of a hair curler.

* * * * *

UNITED STATES PATENT AND TRADEMARK OFFICE

CERTIFICATE OF CORRECTION

PATENT NO. : 5,370,452

DATED : December 6, 1994

INVENTOR(S) : Jeffrey A. Baer

It is certified that error appears in the above-identified patent and that said Letters Patent is hereby corrected as shown below:

Claim 8, column 4, line 50, change "1" to -- 7 --.

Signed and Sealed this

Fourteenth Day of February, 1995

*Attest:*

*Attesting Officer*

BRUCE LEHMAN

*Commissioner of Patents and Trademarks*